United States Patent [19]

Engelstätter

[11] 4,029,992

[45] June 14, 1977

[54] FLASH APPARATUS WITH FLASH TERMINATING SWITCH CONTROLLED BY PHOTOSENSOR

[75] Inventor: Heinz Engelstätter, Bad Soden, Germany

[73] Assignee: Braun Aktiengesellschaft, Frankfurt am Main, Germany

[22] Filed: May 2, 1975

[21] Appl. No.: 574,093

[30] Foreign Application Priority Data

Apr. 8, 1974 Germany ..... 2422237

[52] U.S. Cl. ..... 315/156; 315/151

[51] Int. Cl.² ..... H05B 41/02; H05B 41/32

[58] Field of Search ..... 315/151, 156, 154, 159, 315/149

[56] References Cited

UNITED STATES PATENTS

| | | | |
|---|---|---|---|
| 3,037,144 | 5/1962 | Mantia | 315/154 X |
| 3,519,879 | 7/1970 | Ogawa | 315/151 |
| 3,662,213 | 5/1972 | Dennewitz et al. | 315/149 |
| 3,769,546 | 10/1973 | Pecher et al. | 315/159 X |
| 3,769,546 | 10/1973 | Pecher et al. | 315/159 |
| 3,835,351 | 9/1974 | Schneider | 315/151 X |
| 3,869,642 | 3/1975 | Sabanci | 315/159 X |

*Primary Examiner*—Robert Segal
*Attorney, Agent, or Firm*—Michael J. Striker

[57] ABSTRACT

The light sensitive circuit which controls the voltage at the control electrode of the thyristor used to control the termination of the flash includes a photosensor and a resistor-capacitor integrator circuit connected to the photosensor. The voltage across the capacitor is applied to the control electrode of the thyristor. In accordance with the present invention, a diode connected in series with a variable resistor is connected in parallel with the resistor of the integrator circuit. An additional resistor may be connected in parallel with the capacitor and a further resistor in parallel with the whole integrator circuit in order to allow adjustment of the operating region of the diodes such that it has a very low resistance only when a very high quantity of light as reflected by a very close object impinges upon the photosensor.

6 Claims, 1 Drawing Figure

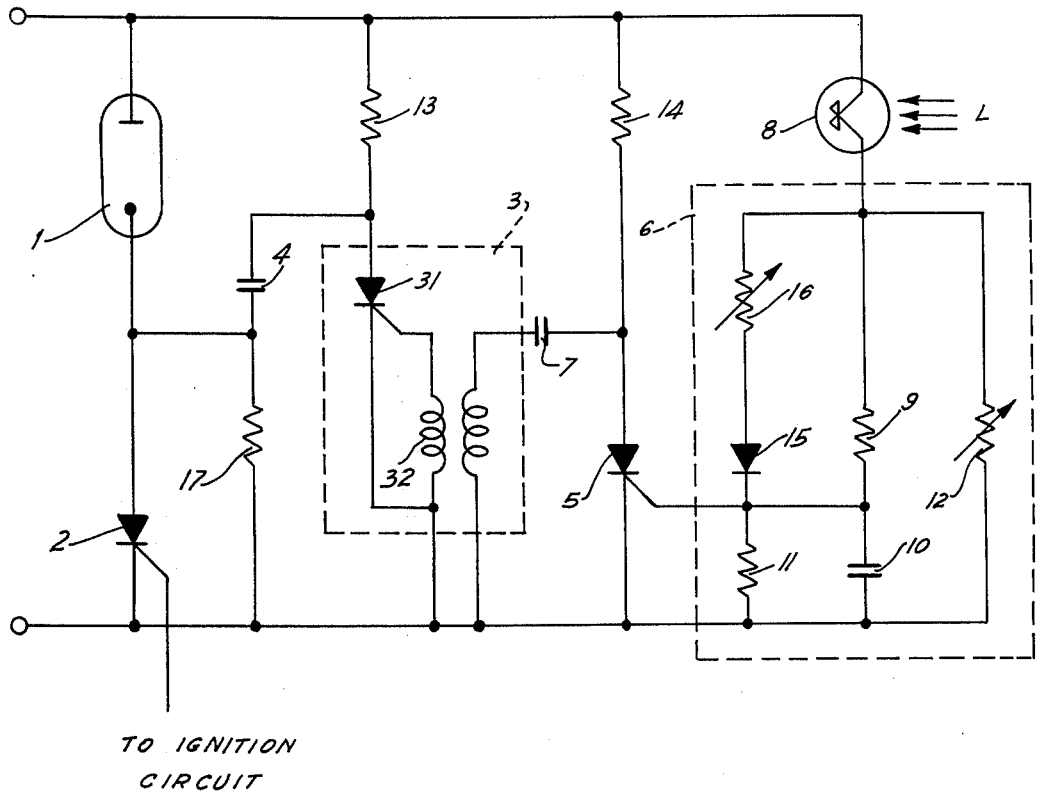
13
14
8
L
1
3
6
4
31
16
7
9
15
17
32
5
12
2
11
10
TO IGNITION
CIRCUIT

FLASH APPARATUS WITH FLASH TERMINATING SWITCH CONTROLLED BY PHOTOSENSOR

BACKGROUND OF THE INVENTION

The present invention concerns the light measuring circuits for electronic computer flash apparatus. In particular it concerns such electronic computer flash apparatus wherein a photosensor receives light reflected by the object to be photographed and wherein the current created in the photosensor is applied to a resistor-capacitor integrator circuit whose output, in turn, is applied to the control electrode of a thyristor which initiates the termination of said flash.

In computer flash apparatus of the above described type, difficulties occur when the object to be photographed is very close to the flash because the action of the circuit in terminating the flash is not sufficiently rapid after a predetermined quantity of light, as determined by the voltage across the capacitor, has been received by the photosensor. For example the thyristors which control the flash termination have a finite operating time and, of course, at least some short delays are introduced by the various other circuit elements connected between the above mentioned thyristor which initiates the termination and the further switching element connected either in series or in parallel with the flash tube whose operation actually terminates the flash. For the large quantities of light falling on a close object and the therefore very short required exposure times, these delays generally result in an overexposure.

SUMMARY OF THE INVENTION

It is an object of the present invention to prevent the overexposure of close objects when using a computer flash apparatus.

The present invention resides in electronic flash apparatus having switch means for initiating the termination of the flash. It comprises a light sensitive circuit including a photosensor, and an integrator circuit having a resistor and capacitor connected to said photosensor. A non-linear resistance circuit element is connected in parallel with the resistor of the integrator circuit. In a preferred embodiment of the present invention, the non-linear resistance circuit element is a diode.

The operation of the arrangement is such that the threshold voltage of the diode is so chosen that after it is exceeded, the diode resistance becomes so low that the signal from the photosensor is applied almost directly to the control electrode of the switch means which, in a preferred embodiment of the present invention, comprises a thyristor. This direct application of the signal from the photosensor to the control electrode of the thyristor has two effects. First, a very high signal is applied to the control electrode of the thyristor which causes the thyristor to switch in a much shorter time period. This, of course, in itself decreases the delay time. Further, the low resistance which is in parallel with the resistance of the resistor of the integrator circuit decreases the time constant of the integrator circuit and thus further decreases the switching time.

It is, of course, desirable that the resistance of the diode be high relative to the resistance of the resistor of the integrator circuit when the quantity of light impinging upon the photosensor is not high, so that the original operation of the integrator circuit remains unchanged. If the resistance of the diode is of the same order of magnitude as that of the resistor of the integrator circuit at lower voltages, the resistance of the diode must, of course, be taken into consideration in the circuit design of the integrator.

Experimentation has shown that the variation in diode resistance can be successfully utilized to eliminate or substantially decrease the delay time in terminating the flash for close objects.

In a further preferred embodiment of the present invention, additional resistors are utilized. These include an adjustable resistor connected in series with the diode and further may include a resistor in parallel with the capacitor of the integrator network and a further adjustable resistor connected in parallel with the whole integrator network, that is with both the resistor and the capacitor. Use of these additional resistors allows the variation of voltage across the diode to be controlled in such a manner that the characteristic curve and, in particular, the knee of said curve is matched to the requirement of the particular circuit.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single Figure shows a light sensitive circuit of the present invention as interconnected in an electronic flash apparatus.

DESCRIPTION OF THE PREFERRED EMBODIMENTS

A preferred embodiment of the present invention will now be described with reference to the drawing.

In the single Figure, the flash tube is denoted by reference numeral 1. A thyristor 2 is connected in series with flash tube 1. The flash initiating circuit which applies a voltage for breaking down thyristor 2 and flash tube 1 substantially simultaneously is not shown here, since it is not connected to the circuit of the present invention. Flash termination results upon receipt of a signal from a pulse circuit denoted by reference numeral 3. Upon firing of circuit 3, a capacitor 4 discharges through thyristor 2, the direction of current from the capacitor being opposite to that generated in flash tube 1 and of sufficient magnitude to cause thyristor 2 to block.

The termination of the flash is initiated by the firing of a thyristor 5. The operation of thyristor 5 is a function of the voltage applied to its control electrode which is connected to the light sensitive circuit 6. Firing of thyristor 5 causes the discharge of capacitor 7 which, when discharging, creates a pulse in transformer 32. The pulse appearing at the secondary winding of transformer 32 is applied to the control electrode of a thyristor 31 which forms part of the circuit 3 mentioned above. Resistors 13, 14 and 17 are utilized to create the correct voltages at the various points in the circuit. It should be noted that the actual operation of the network between thyristor 5 and flash tube 1 is not a part of the present invention and is only included for completeness. The actual invention resides in the circuitry connected to the control electrode of thyristor 5, namely the light sensitive circuit 6.

Returning now to the light sensitive circuit 6, it comprises a photosensor 8 which furnishes an electrical signal as a function of the light (L) impinging thereon, namely the light reflected from the object being photographed. Connected to photosensor 8 is an integrator circuit including a resistor 9 and a capacitor 10. The common point of resistor 9 and capacitor 10 is connected to the control electrode of the above mentioned thyristor 5. A resistor 11 is connected in parallel with capacitor 10, while a resistor 12 is connected in parallel with the integrator circuit, namely with resistor 9 and capacitor 10. The diode 15 which constitutes the heart of the present invention is connected in series with an adjustable resistor 16, the series connection being connected in parallel with resistor 9.

In operation, the voltage appearing across capacitor 10 constitutes the control signal for thyristor 5. Diode 15 which is connected so as to be in a conductive state, of course, constitutes a high resistance when low voltages are applied across it. When, however, the resistance of photoresistor 8 suddenly decreases due to a high quantity of light impinging thereon or, when the current through photosensor 8 suddenly increases rapidly for the same reason, a higher voltage appears across diode 15 causing the diode to act as a very low resistance. When diode 15 acts as a very low resistance, the signal from the photosensor is applied almost directly to the control electrode of thyristor 15. This causes the thyristor to become conductive very rapidly, in turn causing the discharge of capacitor 7, the breakdown of thyristor 31 and, because of the discharge of capacitor 4, the blocking of thyristor 2. This terminates the flash.

The knee of the characteristic curve of diode 15 can, of course, be shifted to the operating region required by photosensor 8 when receiving light reflected from a close object by the proper choice of resistors 11, 16, 9 and 12.

Further, of course, instead of a diode connected with a polarity such that it is conductive, a Zener diode can be used with reverse polarity. Again, the operation of the Zener diode must be such that its breakdown region corresponds to the region required by the circuit when the photosensor receives light from a close object.

It is seen that the present invention constitutes a simple method of compensating for delay times in the integration circuitry of the light sensitive circuit when the computer flash is used to photograph a close object.

While the invention has been illustrated and described as embodied in a specific type of light sensitive circuit and non-linear resistance circuit element, it is not intended to be limited to the details shown since various modifications and circuit changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In the electronic flash unit of the type operative for producing flashes the duration of which is automatically controlled in dependence upon the scene brightness during the flash, in combination, a flash element; means for igniting the flash element; terminating means for terminating the flash produced by the flash element and including an electronic flash-terminating switch having a control electrode and operative when activated for causing the terminating means to terminate the flash; an integrating capacitor and means providing a current path for the capacitor; a charging resistor connected in the current path of the integrating capacitor and carrying a component of the integrating capacitor current, the charging resistor being operative for affecting the rate at which the integrating capacitor charges; means connecting the junction between the charging resistor and the integrating capacitor to the control electrode of the electronic flash-terminating switch for controlling the conductivity of the switch in dependence upon the voltage across the integrating capacitor; a light-sensing element connected in the current path of the integrating capacitor operative for making the capacitor current a function of sensed scene light; and a diode connected across the charging resistor with a polarity such as to carry a further component of the integrating capacitor current, the diode presenting to such further current component a resistance which varies in inverse dependence upon variations in the voltage across the charging resistor.

2. The electronic flash unit defined in claim 1, including a further resistor connected in series with the diode across the charging resistor.

3. The electronic flash unit defined in claim 2, wherein the further resistor is an adjustable resistor.

4. The electronic flash unit defined in claim 1, including a further resistor connected across the integrating capacitor for diverting away from the integrating capacitor a portion of the current flowing in the current path of the integrating capacitor.

5. The electronic flash unit defined in claim 1, including a further resistor connected across the combination of the charging resistor and the integraring capacitor for diverting away from the latter a portion of the current flowing in the current path of the integrating capacitor.

6. The electronic flash unit defined in claim 1, wherein the diode is a zener diode.

* * * * *